US012258100B1

(12) United States Patent
De Luca et al.

(10) Patent No.: US 12,258,100 B1
(45) Date of Patent: Mar. 25, 2025

(54) CONVERTIBLE SEATING SYSTEMS FOR MARINE VESSELS

(71) Applicant: Brunswick Corporation, Mettawa, IL (US)

(72) Inventors: Fabrizio De Luca, Port Orange, FL (US); Daniel S. Freer, New Smyrna Beach, FL (US); J. Andrew Campbell, New Smyrna Beach, FL (US)

(73) Assignee: Brunswick Corporation, Mettawa, IL (US)

( * ) Notice: Subject to any disclaimer, the term of this patent is extended or adjusted under 35 U.S.C. 154(b) by 463 days.

(21) Appl. No.: 17/586,924

(22) Filed: Jan. 28, 2022

(51) Int. Cl.
*B63B 29/04* (2006.01)

(52) U.S. Cl.
CPC ..... *B63B 29/04* (2013.01); *B63B 2029/043* (2013.01)

(58) Field of Classification Search
CPC ..... B63B 17/00; B63B 29/00; B63B 29/04; B63B 2029/043
USPC ..... 114/363
See application file for complete search history.

(56) References Cited

U.S. PATENT DOCUMENTS

| | | | |
|---|---|---|---|
| 250,597 | A | 12/1881 | St. John |
| 427,413 | A | 5/1890 | Fritz |
| 831,877 | A | 9/1906 | Kling |
| 1,224,982 | A | 5/1917 | Washeim |
| 1,271,830 | A | 7/1918 | Austin |
| 1,782,231 | A | 11/1930 | William et al. |
| 1,792,737 | A | 2/1931 | Greenstreet |

(Continued)

FOREIGN PATENT DOCUMENTS

| | | |
|---|---|---|
| CN | 109693587 | 3/2021 |
| DE | 19501521 | 7/1995 |

(Continued)

OTHER PUBLICATIONS

Chris-Craft, Catalina 24. Retrieved from the web: https://www.chriscraft.com/models/catalina-series/catalina-24/ on Jan. 11, 2022.

(Continued)

*Primary Examiner* — Lars A Olson
(74) *Attorney, Agent, or Firm* — Andrus Intellectual Property Law, LLP

(57) ABSTRACT

A convertible seating system for a marine vessel has a leaning post and a reversible seat having a first seat side and a second seat side which is transversely oriented to the first seat side. The reversible seat is coupled to the leaning post and movable into and between a forward seating position located above the leaning post and a rearward seating position located adjacent to the rear of the leaning post. In the forward seating position the first seat side provides a forward seating surface for supporting a seated occupant facing the bow and the second seat side provides a forward backrest surface for supporting the seated occupant facing the bow. In the rearward seating position the second seat side provides a rearward seating surface for supporting a seated occupant facing the stern and the first seat side provides a rearward backrest surface for supporting the seated occupant facing the stern. An actuator is configured to automatically pivot the reversible seat into the forward seating position and also into the rearward seating position.

26 Claims, 11 Drawing Sheets

(56) References Cited

U.S. PATENT DOCUMENTS 2,076,309 A 4/1937 Whedon
2,113,346 A 4/1938 Heath
2,486,468 A 11/1949 Freedman
2,900,009 A 8/1959 Haynes
2,969,107 A 1/1961 Ira et al.
3,107,940 A 10/1963 Brooks et al.
3,379,471 A 4/1968 Dalziel
3,482,870 A 12/1969 Janssen
3,506,303 A 4/1970 Smittle et al.
3,643,528 A 2/1972 van der Loos
3,743,350 A 7/1973 Allen
3,839,757 A 10/1974 Grimes
3,877,747 A 4/1975 Brennan
3,884,522 A 5/1975 Arima et al.
3,964,785 A * 6/1976 Plume ..... A47C 17/34
297/64
4,030,436 A 6/1977 Stoberl
4,088,040 A 5/1978 Ross-Myring
4,099,768 A 7/1978 Amos
4,536,027 A 8/1985 Brennan
4,558,901 A 12/1985 Yokoyama
4,567,845 A 2/1986 Smith
4,693,204 A 9/1987 Klein
4,736,982 A 4/1988 Hwang
4,738,217 A 4/1988 Smith
4,775,187 A 10/1988 Herr
4,843,999 A 7/1989 Kobus et al.
4,854,261 A 8/1989 Goldsmith
4,926,783 A 5/1990 Lathers
5,052,076 A 10/1991 Spaeth
5,052,748 A 10/1991 Fourrey et al.
5,054,857 A 10/1991 Kvalheim
5,107,720 A 4/1992 Hatfield
5,136,963 A 8/1992 Zuzik
5,171,064 A 12/1992 Boussaroque
5,261,727 A 11/1993 Klaebel
5,313,033 A 5/1994 Link et al.
5,320,059 A 6/1994 Ikeda
5,329,871 A 7/1994 Gibbs
5,374,108 A 12/1994 Saul et al.
5,375,907 A 12/1994 Rogers et al.
5,381,585 A 1/1995 Olson et al.
5,531,506 A 7/1996 Scott
5,553,920 A 9/1996 Meschkat et al.
5,613,662 A 3/1997 Blackmore et al.
5,762,402 A 6/1998 Gillotti
5,782,534 A 7/1998 Desanta
5,799,605 A 9/1998 Huse
5,842,743 A 12/1998 Wright et al.
5,904,401 A 5/1999 Alberda
5,913,571 A 6/1999 Dystra et al.
5,976,160 A 11/1999 Crainich
6,196,629 B1 3/2001 Onishi et al.
6,230,648 B1 5/2001 Davidson et al.
6,257,667 B1 7/2001 Boren et al.
6,283,059 B1 9/2001 Scully, Jr.
6,527,341 B1 3/2003 Martin
D481,986 S 11/2003 Menne
6,647,916 B2 11/2003 Neese et al.
6,766,759 B2 7/2004 Eck et al.
6,789,494 B2 9/2004 Neese et al.
6,866,022 B1 3/2005 Phillips et al.
6,880,482 B2 4/2005 Huse
6,883,458 B2 4/2005 Huse
6,918,160 B1 7/2005 Clark
6,940,026 B2 9/2005 Rundell et al.
6,945,190 B1 9/2005 Frandsen
7,000,557 B1 2/2006 Forbes et al.
7,107,927 B2 9/2006 Hopper et al.
7,121,218 B2 10/2006 Stinson et al.
7,156,442 B2 1/2007 McManus
7,172,252 B2 2/2007 Henning
7,255,058 B2 8/2007 Forbes et al.
7,302,906 B2 12/2007 Burroughs et al.
7,341,306 B1 3/2008 Neese et al.
7,367,616 B2 5/2008 Summerford
7,513,211 B1 4/2009 Farb et al.
7,647,880 B2 1/2010 Devine
7,661,382 B2 2/2010 Wood et al.
7,677,668 B2 3/2010 Olsen et al.
7,699,390 B2 4/2010 Baumann
7,819,483 B2 10/2010 Kushner et al.
7,828,383 B1 11/2010 Urbanek et al.
8,002,350 B2 8/2011 Johnson
8,028,641 B1 10/2011 Sly
8,109,563 B2 2/2012 Hansen
8,113,136 B2 2/2012 Mayrand et al.
8,113,137 B2 2/2012 Thompson
8,113,589 B2 2/2012 Mildt et al.
8,499,377 B2 8/2013 Fafard et al.
8,517,466 B1 8/2013 Wizorek et al.
8,720,990 B2 5/2014 Boydston
8,740,297 B1 6/2014 Foss et al.
8,801,099 B2 8/2014 Ebel et al.
8,840,175 B2 9/2014 Short
8,899,169 B1 12/2014 Jaziri
9,021,975 B1 5/2015 Fodor et al.
9,067,517 B1 6/2015 Roeglin et al.
9,073,608 B1 7/2015 Foss et al.
D743,318 S 11/2015 Curts
9,260,166 B1 2/2016 Fodor et al.
9,315,238 B2 4/2016 Neese et al.
9,370,245 B2 6/2016 Fafard et al.
9,403,597 B2 8/2016 Ferry et al.
9,440,560 B2 9/2016 Neese et al.
9,487,273 B1 11/2016 Eekhoff et al.
9,527,555 B2 12/2016 Ketterman et al.
9,650,117 B2 5/2017 Curts et al.
9,688,168 B2 6/2017 Gratz
9,701,368 B2 7/2017 Neese et al.
D794,537 S 8/2017 Wagnon
9,783,271 B2 10/2017 Foss et al.
9,821,887 B1 11/2017 Wilson et al.
9,907,404 B1 3/2018 Sorel et al.
9,919,625 B1 3/2018 Barbier et al.
D819,540 S 6/2018 Wilson et al.
10,005,380 B2 6/2018 Reid et al.
D824,836 S 8/2018 Deurr
10,065,711 B2 9/2018 Fuller, IV et al.
10,065,713 B2 9/2018 Murphy
D830,944 S 10/2018 Deurr
10,085,566 B1 10/2018 Gallant
10,149,544 B2 12/2018 Fafard et al.
10,150,539 B1 12/2018 Wilson et al.
10,207,776 B1 2/2019 Downey et al.
10,328,836 B2 6/2019 Purwin et al.
10,422,167 B2 9/2019 Medina Huerta et al.
D864,081 S 10/2019 Barbier et al.
10,464,639 B2 11/2019 Neese et al.
10,471,859 B2 11/2019 Harrison, III et al.
10,479,233 B2 11/2019 Minato et al.
10,486,777 B1 11/2019 Barbier et al.
D870,016 S 12/2019 Wilson et al.
10,494,061 B2 12/2019 Fafard et al.
10,556,645 B1 2/2020 Levin
10,569,841 B2 2/2020 Fuller, IV et al.
10,759,502 B2 9/2020 Fafard et al.
10,933,774 B2 3/2021 Curts
11,034,414 B1 6/2021 Wilson et al.
11,174,893 B1 11/2021 Freer et al.
11,195,368 B2 12/2021 Patel et al.
11,286,022 B1 3/2022 Freer
2003/0197402 A1 10/2003 McCutcheon et al.
2003/0218369 A1 11/2003 Akaike et al.
2006/0103174 A1 5/2006 Queveau et al.
2007/0114819 A1 5/2007 Dougherty
2007/0158986 A1 7/2007 Adams et al.
2008/0196649 A1 8/2008 Kalil
2008/0236452 A1 10/2008 Pratt et al.
2009/0261629 A1 10/2009 Fafard et al.
2009/0277372 A1 11/2009 Wood et al.
2010/0018451 A1 1/2010 Sahr
2010/0037813 A1 2/2010 Sahr et al.
2010/0037814 A1 2/2010 Sahr et al.

(56) References Cited

U.S. PATENT DOCUMENTS

| | | | |
|---|---|---|---|
| 2010/0201163 | A1 | 8/2010 | Dunkel |
| 2011/0057483 | A1 | 3/2011 | Dickey et al. |
| 2011/0109136 | A1 | 5/2011 | Fafard et al. |
| 2011/0226900 | A1 | 9/2011 | Bamford et al. |
| 2014/0216327 | A1 | 8/2014 | Chen |
| 2014/0265500 | A1 | 9/2014 | Hough et al. |
| 2016/0152169 | A1 | 6/2016 | Zheng et al. |
| 2017/0233042 | A1 | 8/2017 | Curts et al. |
| 2019/0104849 | A1 | 4/2019 | Fafard et al. |
| 2020/0337467 | A1 | 10/2020 | Cannon |
| 2020/0398944 | A1 | 12/2020 | Fafard et al. |
| 2021/0169229 | A1 | 6/2021 | Niemela et al. |
| 2021/0214052 | A1 | 7/2021 | Mast |
| 2022/0258835 | A1 | 8/2022 | Curts |

FOREIGN PATENT DOCUMENTS

| | | |
|---|---|---|
| DE | 60207263 | 7/2006 |
| DE | 102011086751 | 5/2013 |
| GB | 635957 | 4/1950 |
| WO | WO 2019222749 | 11/2019 |

OTHER PUBLICATIONS

Declaration of Prior Art signed by the inventors.

* cited by examiner

CONVERTIBLE SEATING SYSTEMS FOR MARINE VESSELS

FIELD

The present disclosure relates to furniture for marine vessel, and more particularly to convertible seating systems for marine vessels.

BACKGROUND

The following are incorporated herein by reference, in entirety.

U.S. Pat. Nos. 9,919,625; 10,150,539; 11,034,414 disclose a seating system for a marine vessel. The seating system includes a base, and a seat mounted on the base and defining a seating surface. A backrest is configured for movement relative to the base and the seat between a first position and a second position by a backrest transfer arrangement having a movable pivot axis configuration. In the second position, the backrest defines a working surface spaced above and lying generally parallel to the seating surface.

U.S. Pat. No. 10,486,777 discloses a seating system for a marine vessel. The seating system includes a base, and a seat mounted on the base and defining a seating surface. A backrest is configured for movement relative to the base and the seat between a first position and a second position by a backrest transfer arrangement having a movable pivot axis configuration. In the second position, the backrest defines a working surface spaced above and lying generally parallel to the seating surface.

U.S. Pat. No. 11,174,893 discloses a release handle operable to modify a configurable furniture system of a marine vessel. The release handle includes a grip portion configured to be grasped by a user to rotate the release handle and a pivot portion coupled to the grip portion and including a first pivot point and a second pivot point. Both rotation about the first pivot point in a first direction and rotation about the second pivot point in a second direction operate to disengage a locking device and permit a modification of the configurable furniture system.

SUMMARY

This Summary is provided to introduce a selection of concepts which are further described herein below in the Detailed Description. This Summary is not intended to identify key or essential features of the claimed subject matter, nor is it intended to be used as an aid in limiting scope of the claimed subject matter.

A convertible seating system is for a marine vessel having a bow and a stern. In non-limiting embodiments disclosed herein, the convertible seating system comprises a leaning post having a top, a front, a rear, and opposing sides below the top and between the front and the rear. A reversible seat has a first seat side and a second seat side which is transversely oriented to the first seat side. The reversible seat is coupled to the leaning post and movable into and between a forward seating position located above the leaning post and a rearward seating position located adjacent to the rear of the leaning post. In the forward seating position the first seat side provides a forward seating surface for supporting a seated occupant facing the bow and the second seat side provides a forward backrest surface for supporting the seated occupant facing the bow. In the rearward seating position the second seat side provides a rearward seating surface for supporting a seated occupant facing the stern and the first seat side provides a rearward backrest surface for supporting the seated occupant facing the stern. An actuator is configured to automatically pivot the reversible seat into the forward seating position and also into the rearward seating position.

BRIEF DESCRIPTION OF THE DRAWINGS

Embodiments are described with reference to the following drawing figures. The same numbers are used throughout to reference like features and components.

DETAILED DISCLOSURE

During research and development in the field of marine vessels and particularly regarding seating configurations for marine vessels, the present inventors have realized a need for improved seating configurations that are convertible into a variety of positions enabling multiple ergonomic seating and leaning post functionalities.

Figure 1:
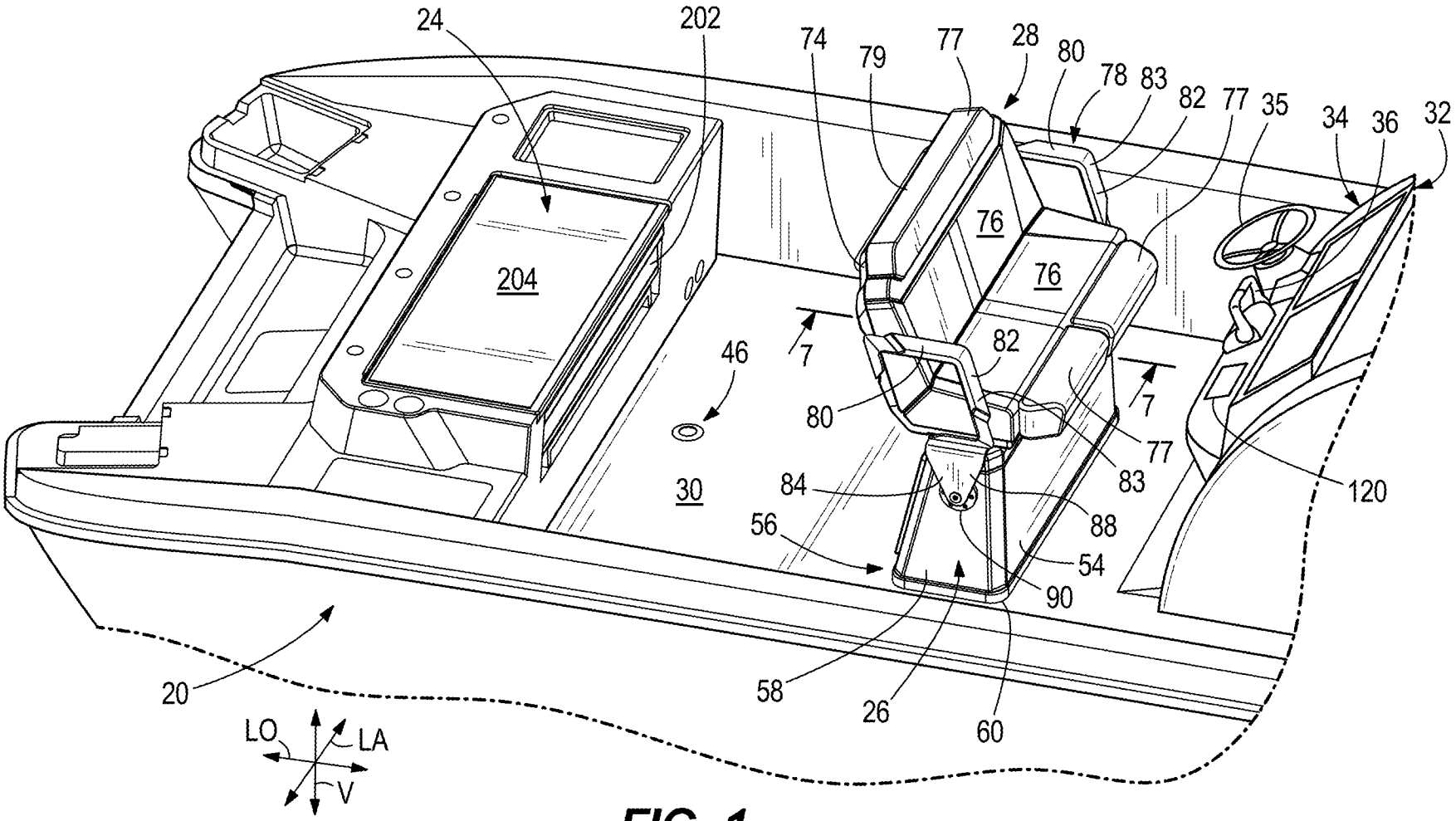
FIG. 1 is a perspective view of a convertible seating system for a marine vessel, illustrating a leaning post and a reversible seat in a forward seating position.
Figure 2:
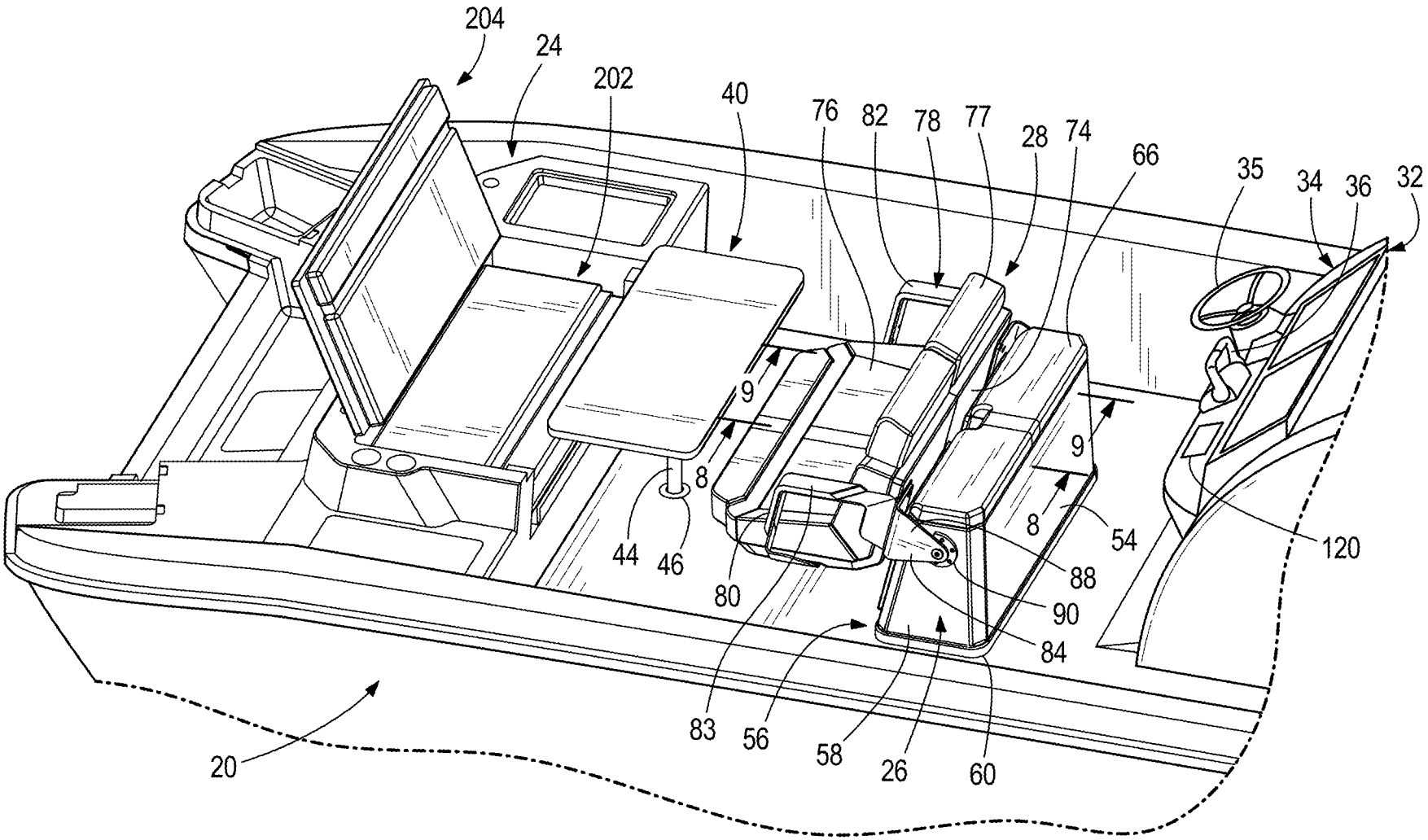
FIG. 2 is a perspective view of the convertible seating system for a marine vessel, illustrating the leaning post and the reversible seat in a rearward seating position.

FIGS. 1 and 2 illustrate an exemplary marine vessel 20 having a novel convertible seating system including a sofa, 24, a leaning post 26, and a reversible seat 28 which is mounted on the leaning post 26 and movable into and between a forward seating position shown in FIG. 1 and a rearward seating position shown in FIG. 2. The sofa 24 is movable into and between a storage position shown in FIG. 1, a seating position shown in FIG. 2, and a sunlounge position which will be further described herein below with reference to FIGS. 10-13. The marine vessel 20 extends from stern to bow in a longitudinal direction LO, from port side to starboard side in a lateral direction LA which is perpendicular to the longitudinal direction LO, and from top to bottom in a vertical direction V which is perpendicular to the longitudinal direction LO and perpendicular to the lateral direction LA. The type and configuration of marine vessel can vary from what is shown.

In the illustrated embodiment, the marine vessel 20 has a deck surface 30 and a helm 32 providing a console 34 having various conventional control devices for controlling movements of the marine vessel 20, for example a steering wheel 35 and throttle/shift levers 36 and/or the like. The leaning post 26 and seat 28 are located laterally between the port and starboard sides and longitudinally proximate to the helm 32 such that an operator standing on the deck surface 30 between the leaning post 26 and helm 32 can manually control movements of the marine vessel 20 via the console 34, and further, as will be further described herein below, such that the operator advantageously has the option to sit on the seat 28 or lean against the leaning post 26 while controlling the marine vessel 20, depending on a current orientation of the seat 28. The sofa 24 is located proximate the stern of the marine vessel 20 and generally faces forwardly towards the leaning post 26 and the bow of the marine vessel 20. In the configuration of FIG. 2, a removable table 40 has a table top 42 which is supported above the deck surface 30 via a table post 44 residing in a bore 46 in the deck surface 30. As shown in FIG. 2, the table 40 provides a dining surface for occupants of the marine vessel 20 seated on the seat 28 in its rearward seating position and for occupants seated on the sofa 24 in its seating position. As will be described herein below, advantageously, the sofa 24 in its seating position and the seat 28 in its rearward seating position together provide seating surfaces which are ergonomically horizontally and vertically aligned with each other, i.e., extending in a common longitudinal-lateral plane at the same ergonomic vertical height above the deck surface 30.

Figure 3:
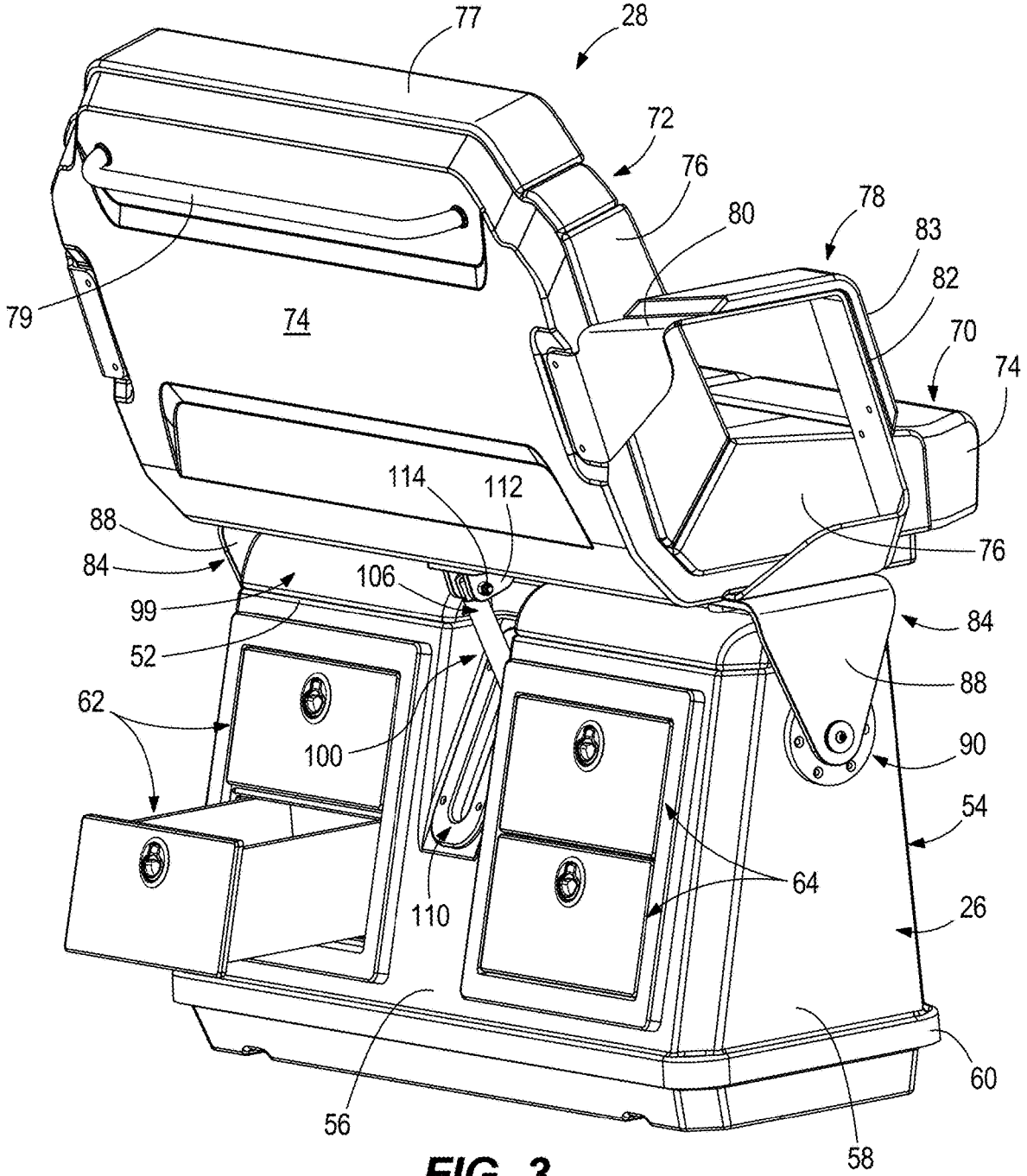
FIG. 3 is a rear perspective view of the leaning post and the reversible seat in the forward seating position.
Figure 4:
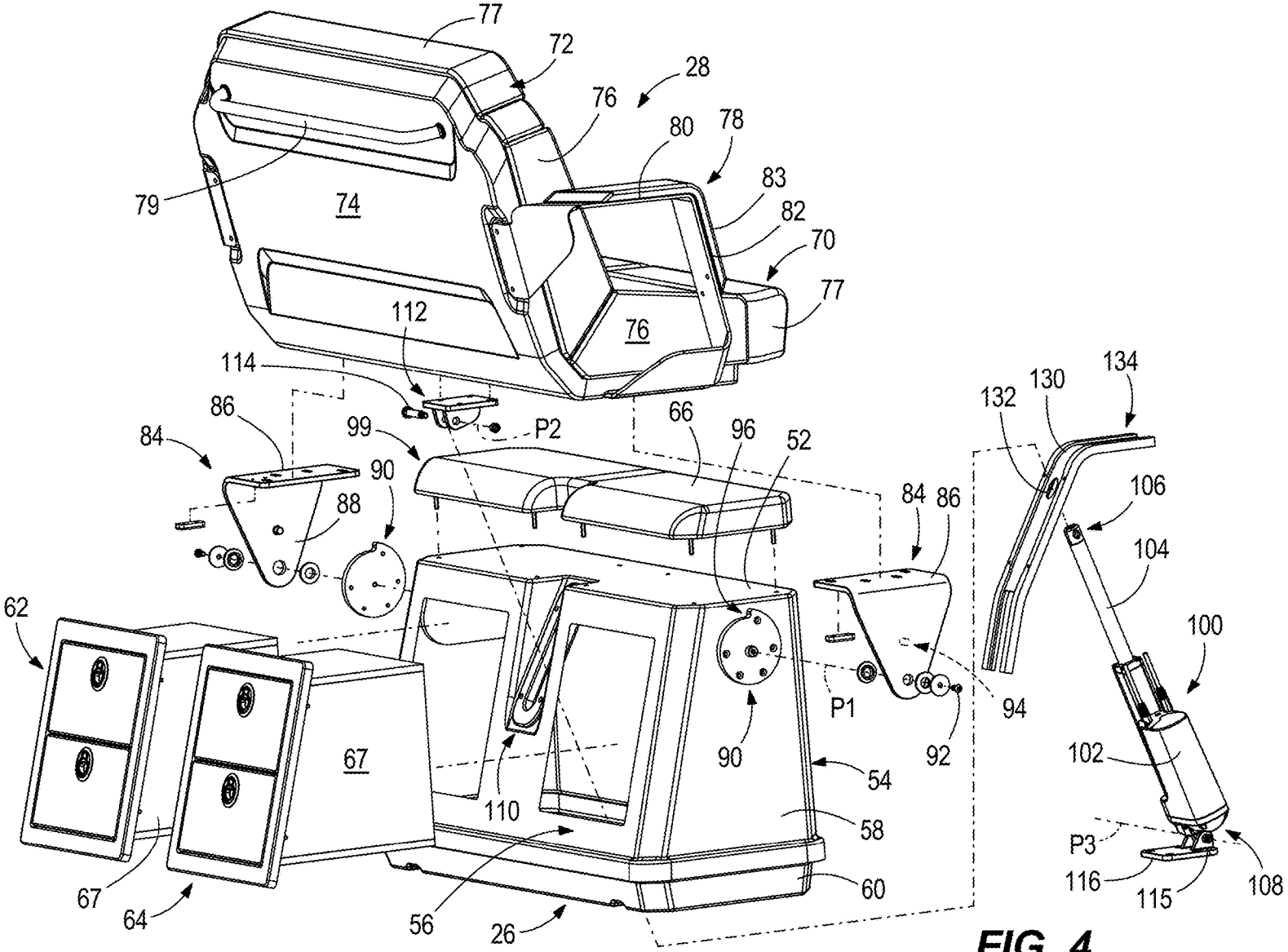
FIG. 4 is an exploded view of the leaning post and the seat.

Now referring to FIGS. 3 and 4, the leaning post 26 includes a generally trapezoidal, prism-shaped body having a top 52, a front 54, a rear 56, and opposing sides 58. The top 52 is a generally flat panel that having an outer surface that extends in the longitudinal and lateral directions LO, LA. The front 54 is a generally flat panel having an outer surface that extends in the lateral direction LA, as well as angularly rearwardly in relative to the vertical and longitudinal directions V. LO. The rear 56 is a generally flat panel having an outer surface that extends in the lateral direction LA, as well as angularly forwardly at an acute angle relative to the deck surface 30 and relative to the vertical and longitudinal directions V. LO, as will be further described herein below. The sides 58 are generally flat panels having an outer surface that extends in the vertical and longitudinal directions V. LO connecting the top 52, front 54 and rear 56. A perimeter supporting base 60 extends around and supports the lower perimeter of the body of the leaning post 26 above the deck surface 30. Two vertically stacked port-side drawers 62 and two vertically stacked starboard-side drawers 64 are slide-able into and out of respective drawer housings 67 supported in cavities in the rear 56 of the leaning post 26, as shown in FIGS. 3 and 4. The drawers 62, 64 advantageously provide an efficient use of storage space within the interior of the leaning post 26. Optionally, for added strength and rigidity the body of the leaning post 26 is made at least partially of fiberglass and it can for example have reinforcing fiberglass ribbing in the interior of the leaning post 26. A seat pad 66 is fastened to the top 52 of the leaning post 26.

The seat 28 has a first seat side 70 and a second seat side 72 that extends generally transversely, for example at an obtuse angle to the first seat side 70. The seat 28 has a seat backing frame or seat base 74. Optionally, the seat 28 has one or more seat cushions 76 attached to the seat base 74 along the first and second seat sides 70, 72. Optionally, the seat 28 has one or more bolster cushions 77 at the outer ends of the first and/or second seat sides 70, 72 for additional cushioning support. The seat base 74 is a generally angular member that is sufficiently rigid to support the seat cushions 76 and bolster cushions 77 on the first and second seat sides 70, 72, and also to support a seated occupant in the forward and rearward seating positions shown in FIGS. 1 and 2. The seat base 74 can be made of one or more than one structural components. The seat 28 has opposed angular armrests 78 which are elongated angular members having a first end fastened to the seat base 74 along the first seat side 70 and an opposite, second end fastened to the seat base 74 along the second seat side 72. The armrests 78 are advantageously configured to provide generally flat, ergonomically located armrest surfaces 80 for an occupant seated in the forward seating position and generally flat, ergonomically located armrest surfaces 82 for an occupant seated in the rearward seating position. One or more resilient pads 83 are affixed to the armrests 78 along the armrest surfaces 80 for cushioning the occupant's elbows and forearms. An elongated handlebar 79 is affixed to the seat base 74 along the rear of the second seat side 72 and provides a manually holding point for an occupant standing on the deck surface 30 behind the seat 28 when the seat 28 is located in the forward seating position.

Figure 5:
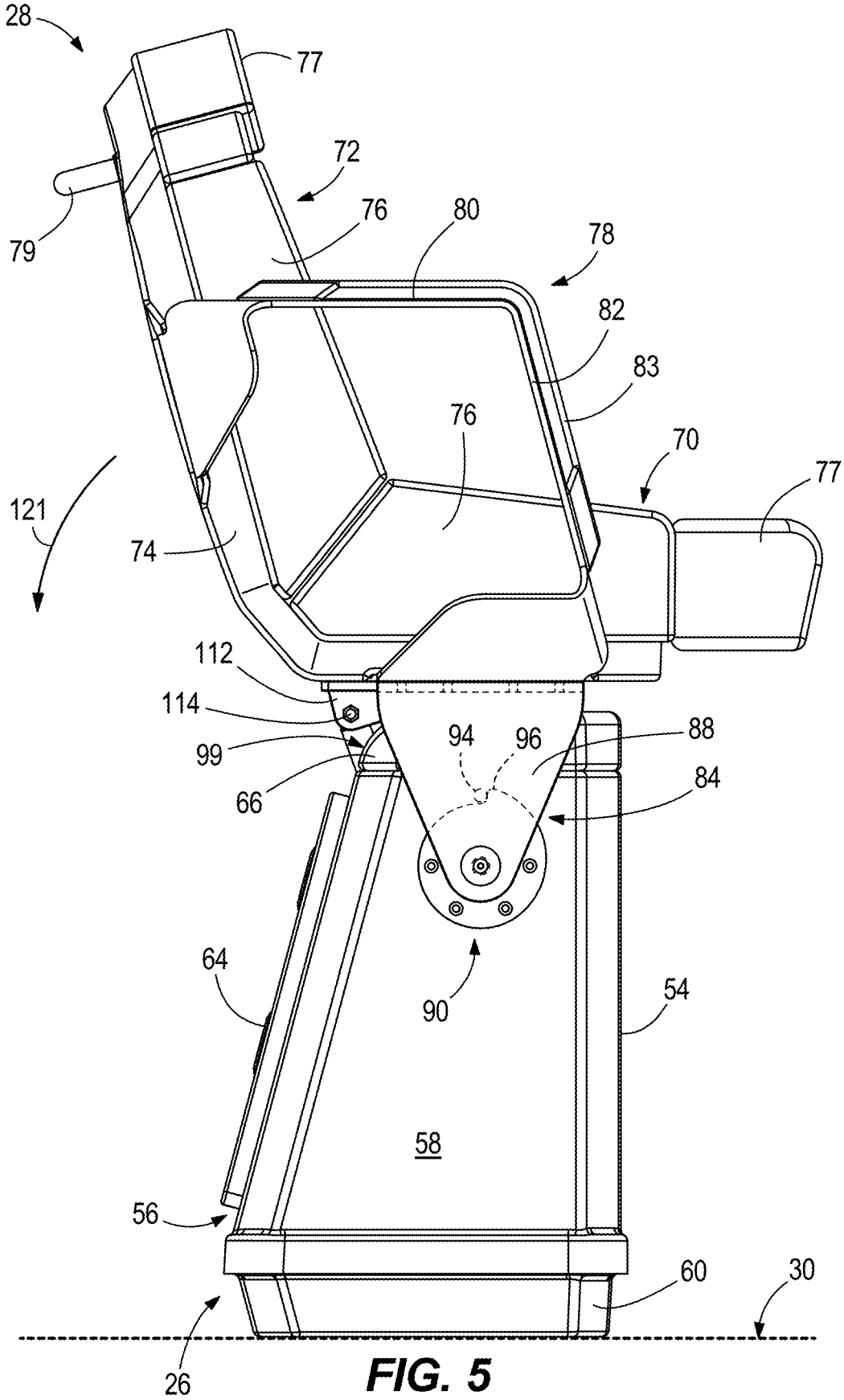
FIG. 5 is a side view of the reversible seat in the forward seating position.

Laterally opposed shoulder brackets 84 extend from opposite sides of the first seat side 70 of the seat base 74. In the illustrated embodiment, the shoulder brackets 84 are fastened to the seat base 74, however in other embodiments the seat base 74 and shoulder brackets 84 are formed together as a monolithic component. Each shoulder bracket 84 is an angular plate-like member having a first leg 86 on the seat base 74 and a second leg 88 which is transversely oriented to the first leg 86. The second leg 88 is pivotably coupled to a respective side 58 of the leaning post 26, as will be further described herein below. Optionally the second leg 88 has a triangular shaped profile when viewed from the side, such as illustrated in FIG. 5. A generally circular, plate-like pivot bracket 90 is fastened to the respective side 58 of the leaning post 26. A fastener 92 (see FIG. 4) extends through a bore in the second leg 88 and into threaded engagement with a threaded bore in the pivot bracket 90. Washers and/or bearings (see FIG. 4) are disposed on the fastener 92 to facilitate smooth pivoting motion of the shoulder brackets 84 and the seat 28 about a pivot axis P1 (scc FIG. 4) defined by the fastener 92. The shoulder brackets 84 are sized so as to separate or provide clearance for the seat base 74 above the seat pad 66 on the top 52 of the leaning post 26 in the forward seating position. The noted clearance provided by the shoulder brackets 84 is advantageously large enough such that during movement of the seat 28 about the pivot axes P1 between the forwardly facing seating position and rearwardly facing seating position, the bottom of the seat base 74 does not contact the rounded corner 99 of the body of the leaning post 26, particularly along where the top 52 is joined to the rear 56.

Figure 6:
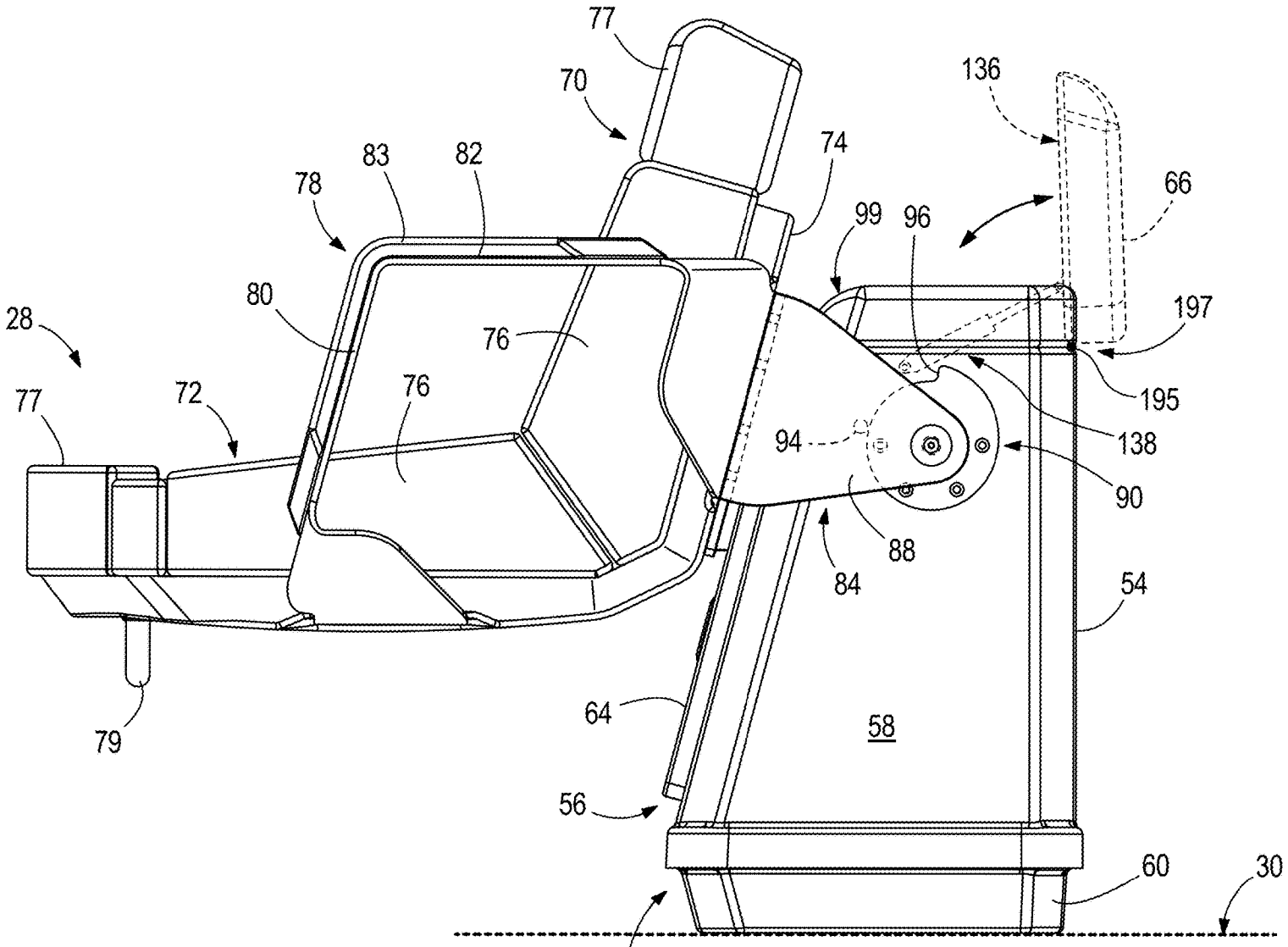
FIG. 6 is a side view of the reversible seat in the rearward seating position, illustrating a top wall of the leaning post in a lowered position in solid lines and in an extended position in dashed lines.

As illustrated in FIGS. 5 and 6, a stop device is provided on each of the shoulder brackets 84 and pivot brackets 90 for limiting rotational movement of the seat 28 into the forward seating position. The type and configuration of the stop device can vary from what is shown and described. In the illustrated embodiment, the stop device is comprised of an engagement finger 94 protruding laterally inwardly from the interior surface of the second leg 88 of the shoulder bracket 84 and a stop surface 96 that extends radially outwardly relative to the outer perimeter of the pivot bracket 90. As will be further described herein below, the engagement finger 94 is positioned such that it travels along the outer perimeter of the pivot bracket 90 as the shoulder bracket 84 is pivoted relative to the pivot bracket 90 towards and away from the forward seating position. When the seat base 74 is pivoted into the forward seating position, the engagement finger 94 engages the stop surface 96, which thereby prevents further rotation of the shoulder bracket 84, thereby preventing over-rotation of the seat base 74 past the forward seating position. Engagement between the engagement finger 94 and stop surface 96 thus advantageously facilitates registration of the seat 28 in the forward seating position.

Figure 7:
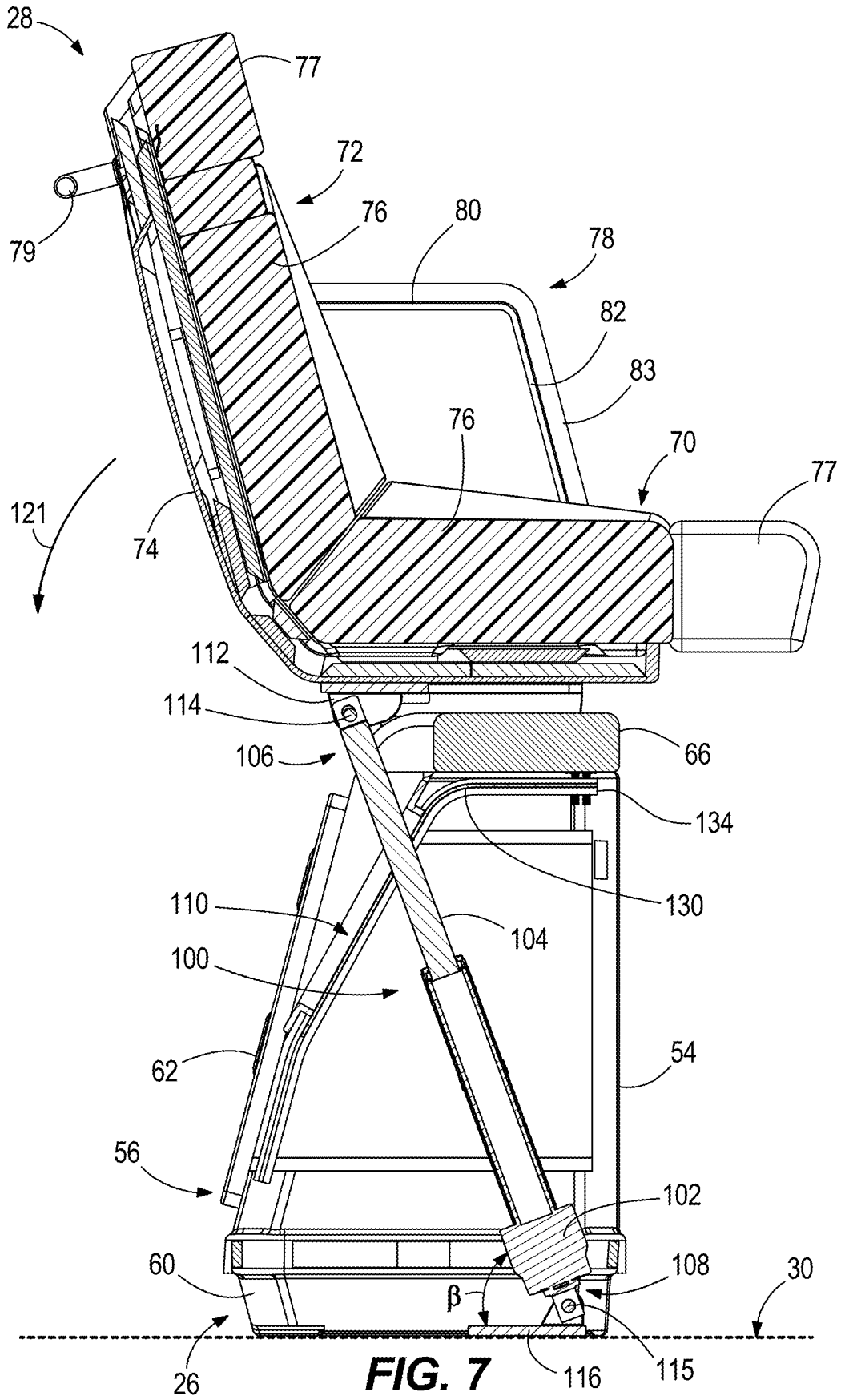
FIG. 7 is a view of section 7-7, taken in FIG. 1.
Figure 8:
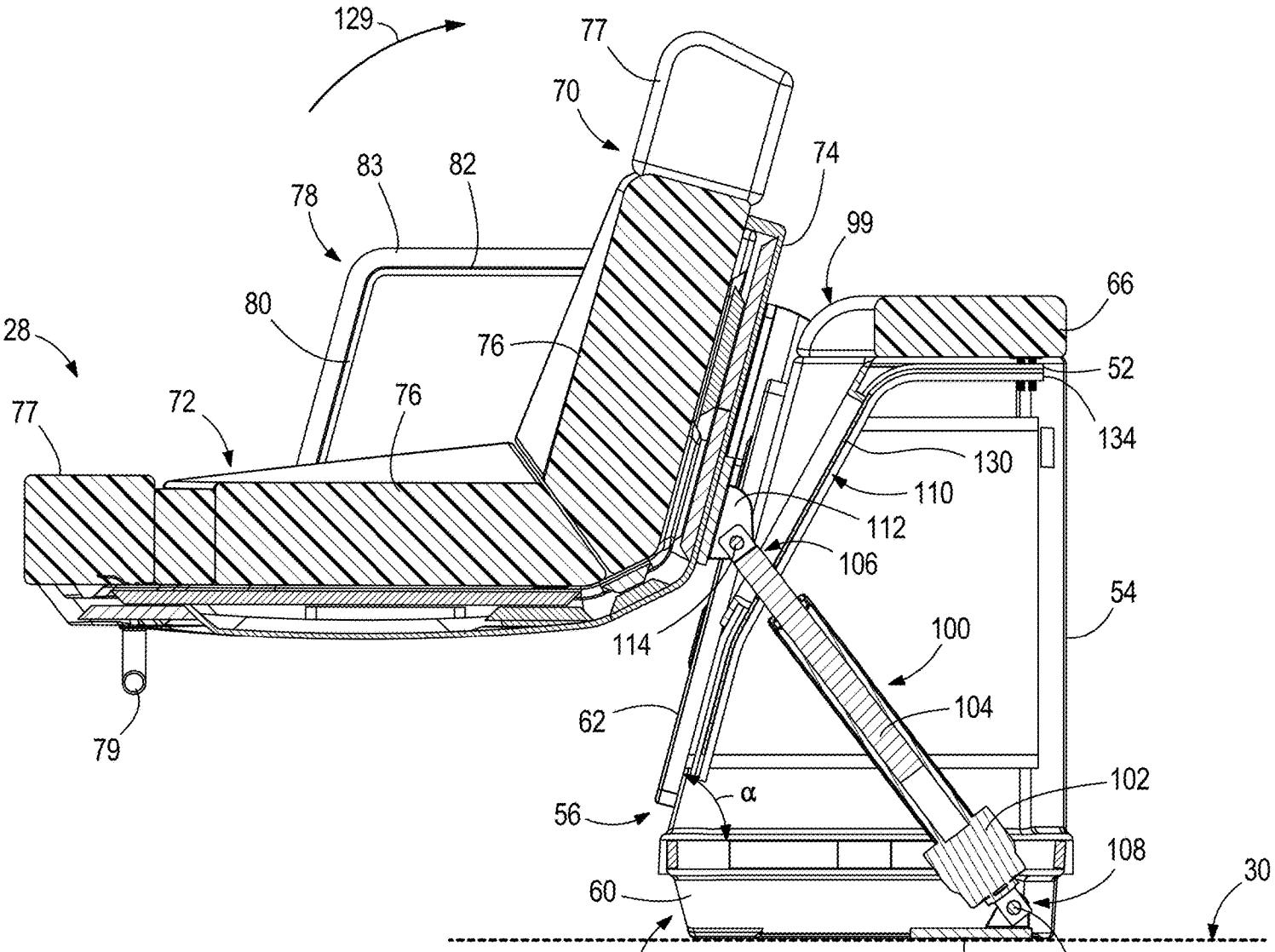
FIG. 8 is a view of section 8-8, taken in FIG. 2.

Therefore, it will be understood from the above description of FIGS. 1-6 and the following description of FIGS. 7 and 8 that the seat 28 is movable into the forward seating position illustrated in FIGS. 1 and 5, in which the seat 28 is located adjacent to and above the top 52 of the leaning post 26, and in which the first seat side 70 provides a forward seating surface for a seated occupant facing the bow of the marine vessel 20 and the second seat side 72 provides a forward backrest surface for the seated occupant facing the bow of the marine vessel 20. In the illustrated embodiment, the seat 28 in the forward seating position accommodates a seated occupant who is operating the noted control devices at the helm 32 (see FIG. 1), for example. It will also be understood from the above description of FIGS. 1-6 that seat 28 is also movable (i.e., reversable) into the rearward seating position illustrated in FIGS. 2 and 6, in which the seat 28 is located adjacent to and rearwardly of the rear 56 of the leaning post 26, and in which the second seat side 72 provides a rearward seating surface for a seated occupant facing the stern of the marine vessel 20 and the first seat side 70 provides a rearward backrest surface for the seated occupant facing the stern of the marine vessel 20 (see FIG. 2). In the illustrated embodiment, the seat 28 in the rearward seating position accommodates a seated occupant who is dining at the table 40, for example.

Referring now to FIGS. 4 and 7-8, an actuator 100 is configured to automatically pivot the seat 28 into the forward seating position and into the rearward seating position. The type and configuration of the actuator 100 can vary from what is illustrated and described. In the illustrated embodiment, the actuator 100 is a linear actuator of the type commercially available for sale by Linak US Inc. The actuator 100 has an electric motor 102 which is configured to cause extension of a drive screw or rod 104 so at to lengthen the linear actuator, and alternately to cause retraction of the rod 104 so as to shorten the linear actuator. A power source such as a conventional battery provides electric power to the electric motor 102, which in turn converts the electric power into the mechanical power necessary to lengthen and retract the rod 104. The actuator 100 has a first actuator end 106 and an opposite, second actuator end 108. In illustrated embodiment, the first actuator end 106 is the rod end and the second actuator end 108 is the motor end.

The first actuator end 106 protrudes through a slot 110 in the rear 56 of the leaning post 26. A mounting bracket 112 couples the first actuator end 106 to the middle of the seat base 74, particularly along the half of the first seat side 70 which is next to the second seat side 72. In other words, the bracket 112 is off-center relative to the first seat side 70, closer to the second seat side 72. So the first actuator end 106 is pivotably coupled to the seat base 74 closer to the second seat side 72 than to the outer end of the first seat side 70. A fastener 114 fastens the first actuator end 106 to the mounting bracket 112 and defines a pivot axis P2 (see FIG. 4) about which the seat 28 can pivot relative to the actuator 100.

The second actuator end 108 is located in the interior of the leaning post 26. A mounting bracket 116 pivotally mounts the second actuator end 108 to the deck surface 30 below the interior of the leaning post 26. A fastener 115 fastens the second actuator end 108 to the mounting bracket 116 and defines a pivot axis P3 (see FIG. 4) about which the seat 28 and actuator 100 can pivot relative to the deck surface 30. Thus the second actuator end 108, including the electric motor 102, is located in the interior of the leaning post 26, while the first actuator end 106, including the rod 104, protrudes outwardly from the interior of the leaning post 26 via the slot 110. In other embodiments, the mounting bracket 116 could pivotably couple the second actuator end 108 to an interior surface of the leaning post 26 instead of or in addition to the deck surface 30.

Referring to FIG. 7, in the extended position, the actuator 100 extends at an acute angle $\beta$ from to the deck surface 30 and is in a pivotable engagement with the rear portion of the first seat side 70, near the second seat side 72, as described above. In this orientation, the actuator 100 in its extended position provides an angular brace that helps automatically retain the seat 28 into the forward seating position, i.e., by resisting pivoting movement of the seat 28 towards the rearward seating position in the direction of arrow 121. More specifically, the electric motor 102 is configured to resist retraction of the rod 104 unless it is actuated to do so. It normally retains the rod 104 in the extended position shown. Because the actuator 100 has a length that is made rigid by the electric motor 102 in its dormant state, and further because the actuator 100 extends at the acute angle $\beta$ relative to the deck surface 30 (and also relative to planar first seat side 70) pivoting movement of the seat 28 in the direction of arrow 121 is prevented by the actuator 100.

Figure 9:
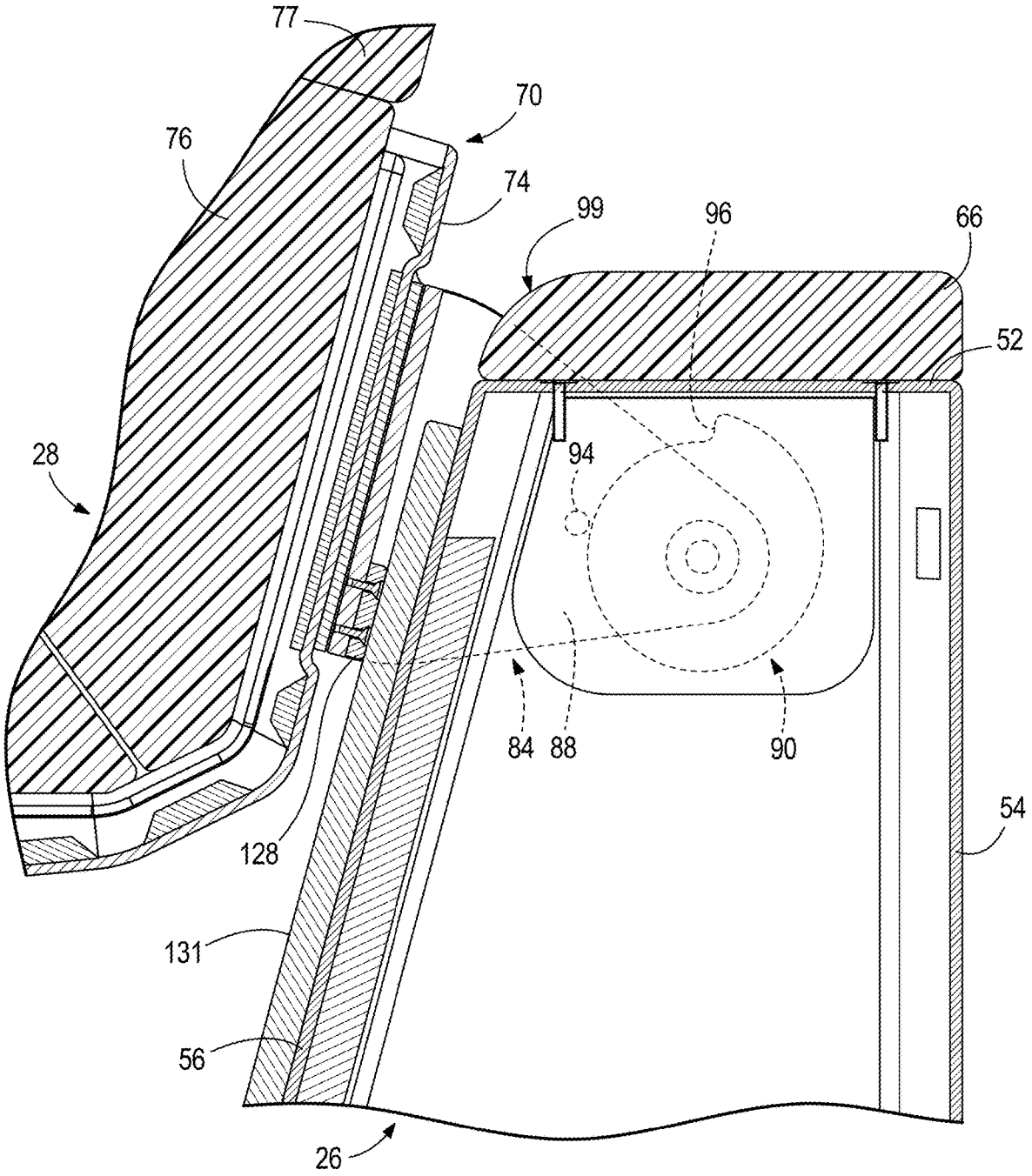
FIG. 9 is a view of section 9-9, taken in FIG. 2.

Referring to FIGS. 8 and 9, in the rearward seating position, the seat 28 is supported by engagement between the seat base 74 along the first seat side 70 and the rear 56 of the leaning post 26. As shown in FIG. 8, the rear 56 of the leaning post 26 extend at an acute angle $\alpha$ relative to the deck surface 30 so as to provide support for the weight of the seat 28 in the rearward seating position and for an occupant sitting on the seat and facing the stern of the marine vessel 20. As shown in FIG. 9, shims 128 are fastened to the rear/lower ends of the interior surfaces of the first legs 86 of the shoulder brackets 84 and abut outer engagement surfaces 131 on the rear 56 of the leaning post 26 when the seat 28 is in the rearward seating position. Optionally the shims 128 and/or the outer engagement surfaces 131 can be made of a resilient, scratch resistant material such as rubber or the like.

Referring to FIG. 8, the seat 28 is retained in the rearward seating position, by the force of gravity causing engagement between the shims 128 and the outer engagement surfaces 31 of the rear 56 of the leaning post 26. Movement of the seat 28 in the direction of arrow 129 (see FIG. 7) is also prevented by the rigid actuator 100 in its dormant state. In its dormant state, the electric motor 102 normally retains the rod in the retracted position shown, thus retaining the shims 128 against the outer engagement surfaces 131 so as to prevent pivoting movement of the seat 28 about the pivot axis P3 (see FIG. 4), further helping register the seat base 74 in the cantilevered position shown.

Referring to FIGS. 1 and 2, a user input device 120 located at the helm 32 is communicatively connected to the actuator 100 and provides the ability to control movement of the actuator 100 into the above-described extended and retracted positions. The location of the user input device 120 can vary from what is illustrated, and for example can be located on the leaning post 26 or elsewhere. In some embodiments the user input device 120 comprises a manual switch, for example a toggle switch wherein operation of the toggle switch in a first direction causes extension of the actuator 100 and operation of the toggle switch in an opposite, second direction causes retraction of the actuator 100. In other embodiments, the user input device 120 comprises a momentary-style switch wherein a first operation of the momentary-style switch causes extension of the actuator 100 and then a subsequent second operation of the momentary-style switch causes retraction of the actuator 100. In other embodiments, the user input device 120 is provided by a menu option on a conventional touch screen. Many other examples of user input devices for controlling movement of the actuator 100 are possible and contemplated by the present disclosure. The user input device 120 and actuator 100 can be communicatively connected by wired and/or wireless links, including for example via WIFI and/or Bluetooth. The type of user input device 120 can vary within the known skill in this art.

It will thus be understood that the seat 28 is movable from the forward seating position (FIGS. 5 and 7) to the rearward seating position (FIGS. 6 and 8) by actuating the actuator 100 via the user input device 120 to reduce the length of the actuator 100. To move the seat 28 from the forward seating position to the rearward seating position, the user operates the user input device 120 to retract the actuator 100. Due to the force of gravity and also due to the rearward angle of the actuator 100 when the actuator 100 is extended and the seat 28 is in the forward seating position, retraction of the actuator 100 causes the seat to the pivot rearwardly downwardly about the pivot axis P1, and causes the actuator 100 and seat 28 to pivot rearwardly downwardly about the pivot axis P3 in the direction of arrow 121. This occurs as the rod 104 of the actuator 100 to move downwardly along the slot 110. Further, due to the location of the pivot axis P2 relative to inner half of the first seat side 70 of the seat 28, a moment force is created which pulls on the seat 28 to cause it to concurrently pivot about the pivot axis P2 until the seat 28 is in the rearward seating position illustrated in FIGS. 6 and 8. The seat 28 reaches the rearward seating position once the actuator 100 is fully retracted and the seat 28 is cantilevered relative to the rear 56 of the leaning post 26, as illustrated in FIGS. 6 and 8, and further once the rear 56 of the leaning post 26 supports the weight of the seat 28 and optionally an occupant sitting on the seat and facing the stern of the marine vessel 20 via engagement with shims 128.

Conversely, the seat 28 is movable from the rearward seating position (FIGS. 6 and 8) to the forward seating position (FIGS. 5 and 7) by controlling the actuator 100 via the user input device 120 to extend the actuator 100. Due to the angle of the actuator 100 in the rearward seating position and location of the pivot axis P2 on the inner half of the first seat side 70, extension of the actuator 100 causes the seat 28 to pivot about the pivot axis P1 opposite the direction of arrow 121, and causes the actuator 100 and seat 28 to pivot upwardly about the pivot axis P3 opposite the direction of arrow 121. As this occurs, location of the pivot axis P2 close to where the first seat side 70 transitions to the second seat side 72 creates a moment force which causes the seat 28 to pivot about the pivot axis P2, clockwise as shown, until the seat 28 is in the forward seating position illustrated in FIGS. 5 and 7. This occurs while the rod 104 of the linear actuator moves upwardly along the slot 110. The seat 28 reaches the forward seating position once the actuator 100 is fully extended, as shown in FIGS. 6 and 8, and the engagement finger 94 engages the stop surface 96, which prevents over rotation of the seat base 74, and which securely registers the seat in the forward seating position.

Advantageously the embodiments described herein above can be implemented without a need for latches or other complicated mechanisms facilitating movement and retention in the positions shown.

Optionally, referring to FIG. 4, a flexible cover 130 covers the slot 110. The cover 130 for example can be made of cloth or any other flexible water-resistant material. The cover 130 has a hole 132 through which the rod 104 extends. The cover 130 is secured to the interior surfaces of the top 52 and rear 56 of the leaning post 26 by a track 134. Movement of the rod 104 along the slot 110 causes the rod 104 to engage and slide the cover 130 along the track 134. The cover 130 is large enough so that as it slides along the track 134 it continuously covers the slot 110. Thus the slot 110 remains covered by the cover 130 both during extension and retraction of the actuator 100, preventing ingress of environmental contaminants to the interior of the leaning post 26.

Optionally, referring to FIG. 6, the top of the leaning post 26 has a top wall 136 which is movable into and between the lowered position illustrated in solid lines and the raised position illustrated in dashed lines. In the lowered position, the top wall 136 and seat pad 66 provide another seat surface for an occupant facing the bow when the seat 28 is in the rearward seating position. In the illustrated example, the top wall 136 and seat pad 66 are pivotable about a hinge 195 located at the front corner 197 of the leaning post 26, where the top 52 meets the front 54. In some embodiments, the top wall 136 is manually pivotable into and between the lowered and raised positions. In some embodiments, one or more conventional gas springs 138 are connected to the top wall 136 and the side(s) 58 of the leaning post 26 and provide an assistance force for pivoting movement of the top wall 136 and/or prevent the top wall 136 from free-falling from the raised position to the lowered position. In some embodiments, one or more actuators, such as commercially available from Linak, are provided for automatically moving the top wall 136 into the lowered and raised positions, for example based on an input to the user input device 120. In other examples, the top wall 136 could be telescopically movable up and down relative to the top 52 of the leaning post 26.

Figure 10:
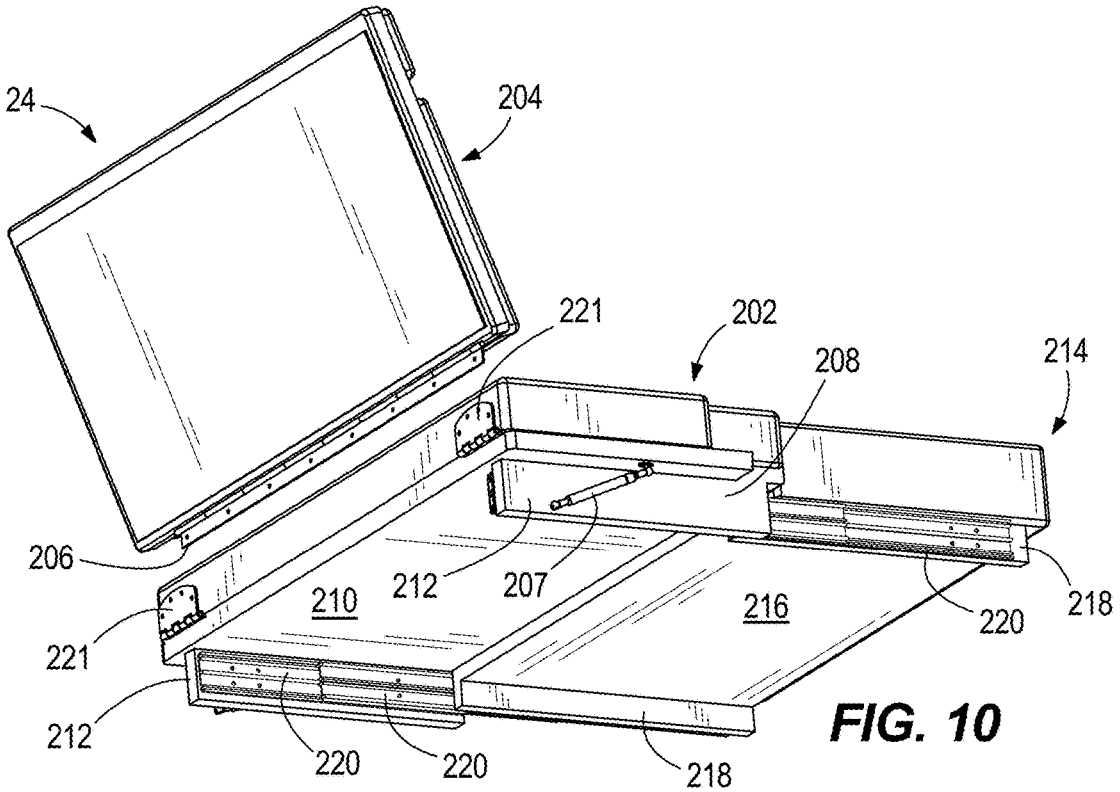
FIG. 10 is view of a sofa including a sofa backrest and a sofa seat having a sofa base and a sofa bed which is slid out from under the sofa base into a lounge position in which the sofa base and the sofa bed together provide a contiguous sunpad for a person laying on the sofa seat.
Figure 11:
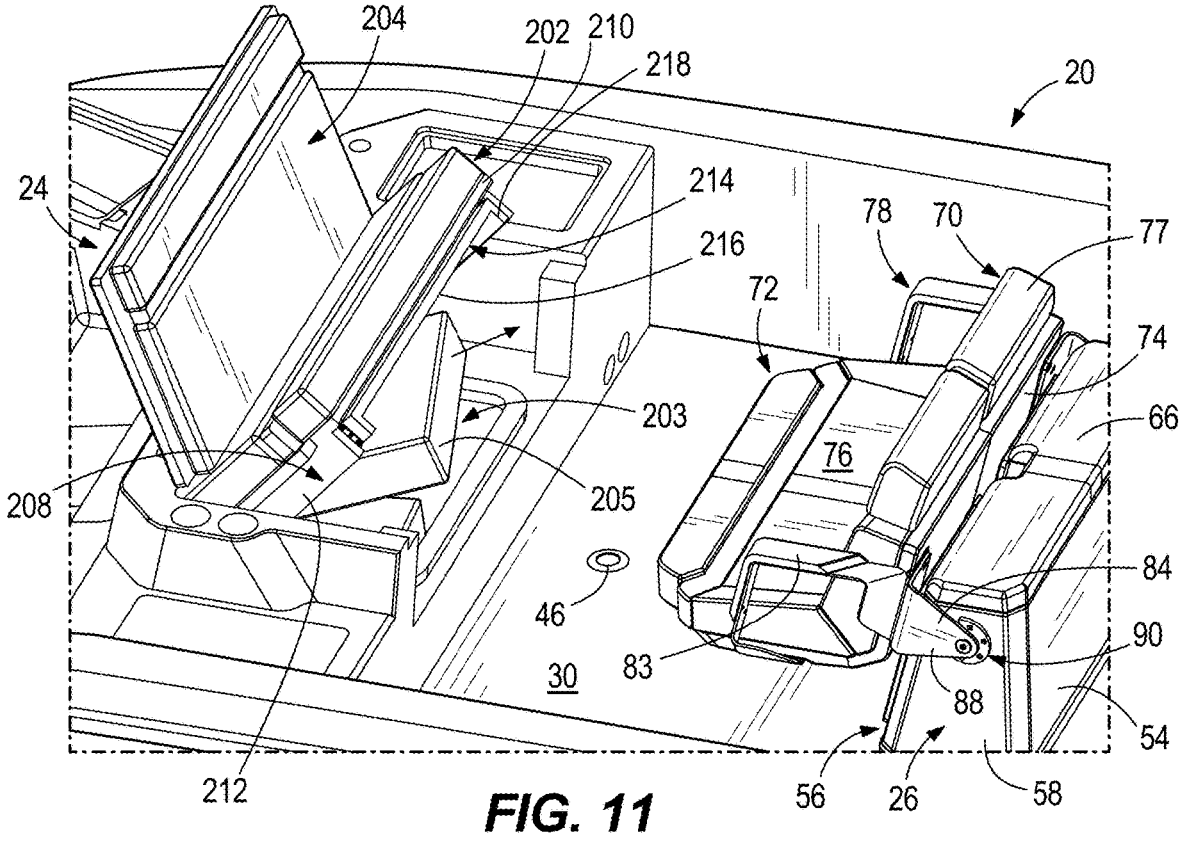
FIG. 11 is a perspective view of the convertible seating system illustrating the reversible seat in the rearward seating position and the sofa seat pivoted upwardly relative to a sofa frame to expose a storage area below the sofa seat.
Figure 12:
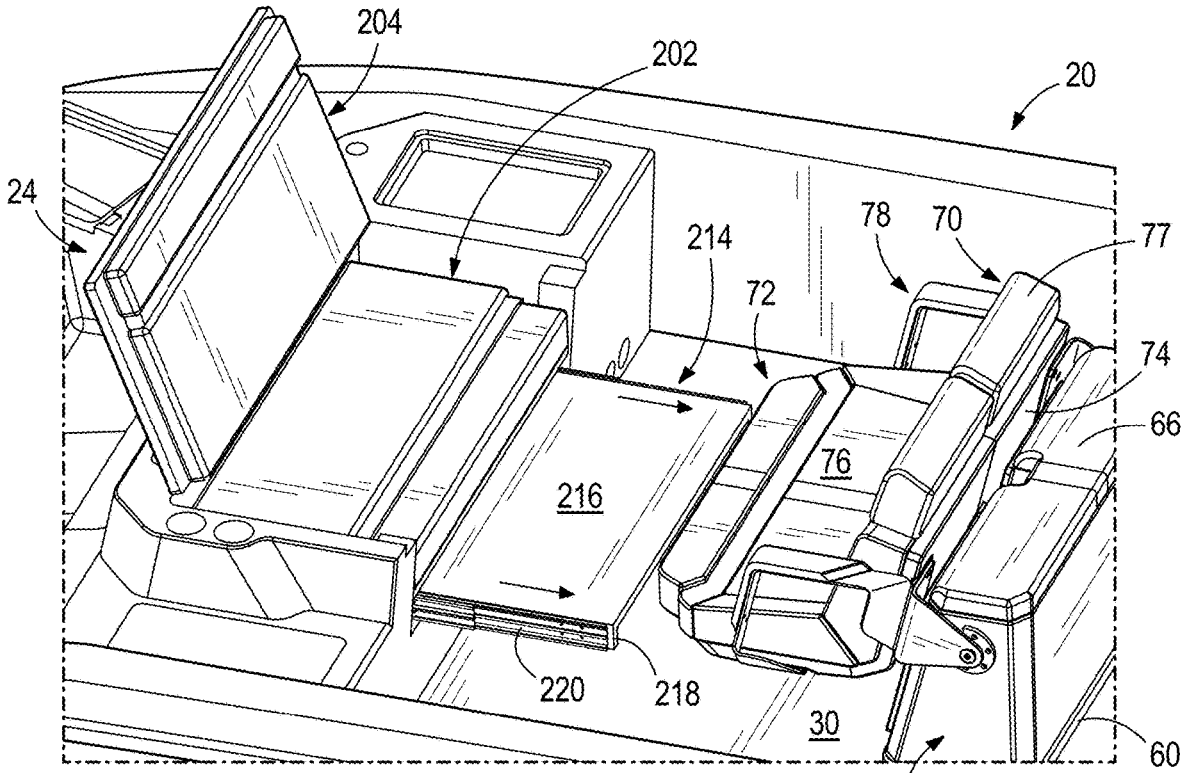
FIG. 12 is a view like FIG. 11, illustrating the sofa bed slid out from under the sofa base into the lounge position.
Figure 13:
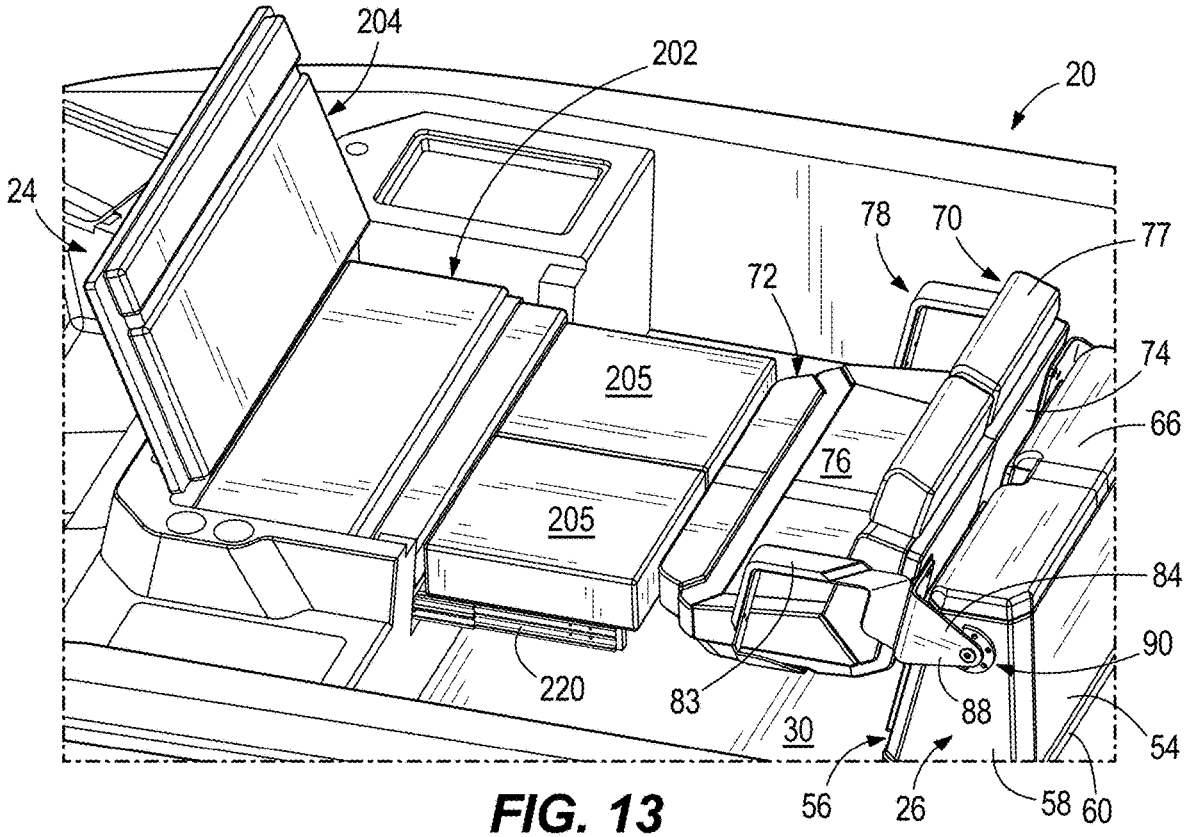
FIG. 13 is a view like FIG. 11, illustrating sofa bed cushions on the sofa bed.

Now referring to FIGS. 10-13, the convertible seating system also has a sofa 24, which is located near the stern of the marine vessel 20. The sofa 24 has a sofa seat 202 which is a generally planar member that is elongated in the lateral direction LA relative to the port and starboard sides of the marine vessel 20. The sofa seat 202 provides seating support for one or more seated occupants facing the bow of the marine vessel. The sofa 24 also has a sofa backrest 204 which extends generally transversely upwardly relative to the sofa seat 202 at an ergonomic obtuse angle when the sofa 24 is in the seating position illustrated in FIG. 2. Referring to FIG. 10, the sofa backrest 204 is a generally planar member which is elongated in the lateral direction LA relative to the port and starboard sides of the marine vessel 20 for providing backrest support to more than one seated occupant facing the bow of the marine vessel 20. The sofa backrest 204 is pivotably coupled to the rear of the sofa seat 202 by a conventional piano-style hinge 206 such that the sofa backrest 204 is pivotable into and between the storage position illustrated in FIG. 1 and the seating position illustrated in FIG. 2. In the storage position, the rear surface of the sofa backrest 204 provides a standing surface for an occupant of the marine vessel, for fishing, diving, or various other recreational activities.

A sofa frame 208 underlies and supports the sofa seat 202 and the sofa backrest 204. The sofa frame 208 includes side frame members 212 located below and on opposite sides of the sofa seat 202. The rear of the sofa seat 202 is pivotably coupled to the hull of the marine vessel 20 by hinges 221 such that the sofa seat 202 is pivotable into the raised position illustrated in FIG. 11, which exposes a storage area 203 defined by the hull of the marine vessel 20 beneath the sofa 24. Optionally, one or more sofa bed cushions 205 are stored in the storage area 203. Optionally one or more conventional gas-spring assist devices 207 are coupled to the sofa seat 202 and the hull of the marine vessel 20 to facilitate easier manual pivoting of the sofa seat 202 and to prevent free fall of the sofa seat 202 from the raised position.

Referring to FIG. 10, the sofa 24 also has a sofa bed 214. The sofa bed 214 includes a base member 216 and side frame members 218 located below and on opposite sides of the base member 216. The base member 216 is a generally planar member that is elongated in the lateral direction LA relative to the port and starboard sides of the marine vessel. The base member 216 is narrower in the lateral direction LA than the sofa seat 202 such that the base member 216 can be positioned below the base member 210, between the side frame members 218. Slide rails 220 are located on the inside of the side frame members 212 and on the outside of the side frame members 218. The slide rails 220 are engaged with each other in a conventional drawer-slide-type arrangement such that the sofa bed 214 is slide-able relative to the sofa seat 202 into and between the positions illustrated in FIGS. 11 and 12. In particular, as shown by arrows in FIG. 12, the sofa bed 214 is slide-able out from under the sofa seat 202 into the lounge position shown, in which the sofa seat 202 and sofa bed 214 together provide a contiguous sunpad for a person laying in a prone position. Prior to moving the sofa bed 214 into the lounge position, the occupant of the marine vessel 20 can remove the sofa bed cushions 205 from the storage area 203 and then once the sofa bed 214 is moved into the lounge position, the sofa bed cushions 205 are placed on the sofa bed 214 as shown. In this way, the cushions on the sofa seat 202, the sofa bed cushions 205, seat cushions 76 and optionally bolster cushions 77 are vertically aligned relative to the deck surface 30 of the marine vessel 20 and provide a single contiguous sunpad for the occupant to lie in a prone position.

In the present description, certain terms have been used for brevity, clarity, and understanding. No unnecessary limitations are to be implied therefrom beyond the requirement of the prior art because such terms are used for descriptive purposes only and are intended to be broadly construed. The different apparatuses described herein may be used alone or in combination with other apparatuses. Various equivalents, alternatives and modifications are possible within the scope of the appended claims.

What is claimed is:

1. A convertible seating system for a marine vessel having a bow and a stern, the convertible seating system comprising:

a leaning post having a top, a front, a rear, and opposing sides below the top and between the front and the rear;

a reversible seat having a first seat side and a second seat side which is transversely oriented to the first seat side, the reversible seat being coupled to the leaning post and being movable into and between a forward seating position located above the leaning post and a rearward seating position located adjacent to the rear of the leaning post, wherein in the forward seating position the first seat side provides a forward seating surface for supporting a seated occupant facing the bow and the second seat side provides a forward backrest surface for supporting the seated occupant facing the bow, and wherein in the rearward seating position the second seat side provides a rearward seating surface for supporting a seated occupant facing the stern and the first seat side provides a rearward backrest surface for supporting the seated occupant facing the stern; and an actuator configured to automatically pivot the reversible seat into the forward seating position and also into the rearward seating position.

2. The convertible seating system according to claim 1, wherein the reversible seat comprises seat base having opposing seat sides which are pivotably coupled to the leaning post.

3. The convertible seating system according to claim 1, wherein the actuator comprises a linear actuator.

4. The convertible seating system according to claim 3, wherein the linear actuator comprises a first actuator end that is pivotably coupled to the reversible seat.

5. The convertible seating system according to claim 4, wherein the linear actuator comprises a second actuator end that is pivotably coupled to a surface in an interior of the leaning post.

6. The convertible seating system according to claim 5, wherein the surface in the interior of the leaning post is a deck of the marine vessel.

7. The convertible seating system according to claim 3, wherein extension of the linear actuator pivots the reversible seat into the forward seating position and wherein retraction of the linear actuator pivots the reversible seat into the rearward seating position.

8. The convertible seating system according to claim 7, wherein in an extended position the linear actuator resists rotation of the reversible seat out of the forward seating position.

9. The convertible seating system according to claim 7, wherein in a retracted position the linear actuator supports the reversible seat in the rearward seating position.

10. The convertible seating system according to claim 3, further comprising a slot in the rear of the leaning post through which the linear actuator extends.

11. The convertible seating system according to claim 10, wherein extension and retraction of the linear actuator causes the linear actuator to move upwardly and downwardly along the slot, respectively.

12. The convertible seating system according to claim 10, further comprising a cover on the slot, wherein the cover slides along the slot with the linear actuator so that the slot remains covered by the cover during extension and retraction of the linear actuator.

13. The convertible seating system according to claim 1, wherein the reversible seat comprises seat base having opposing seat sides that are pivotably coupled to the leaning post, and further comprising armrests on the opposing seat sides, the arm rests providing armrest surfaces for an occupant seated in a forward seating position and also providing armrest surfaces for an occupant seated in a rearward seating position.

14. The convertible seating system according to claim 1, wherein the reversible seat comprises seat base having opposing seat sides that are pivotably coupled to the leaning post, and further comprising opposing shoulder brackets that couple the opposing seat sides of the seat base to the leaning post, and further comprising a stop device configured to stop movement of the reversible seat when the reversible seat is moved into the forward seating position.

15. The convertible seating system according to claim 1, wherein the reversible seat comprises seat base having opposing seat sides that are pivotably coupled to the leaning post, and wherein in the rearward seating position, the reversible seat is supported via engagement between the seat base and the rear of the leaning post.

16. The convertible seating system according to claim 1, wherein the rear of the leaning post extends at an acute angle relative to a deck surface of the marine vessel so as to provide support for the reversible seat when the reversible seat is moved into the rearward seating position.

17. The convertible seating system according to claim 1, further comprising a manual input device for controlling the actuator.

18. The convertible seating system according to claim 1, wherein the top of the leaning post comprises a top wall, and wherein the top wall provides a second seat surface for the seated occupant facing the bow when the reversible seat is in the rearward seating position.

19. The convertible seating system according to claim 18, wherein the top wall is movable into and between a lowered position providing the second seat surface and a raised position providing a leaning support for an occupant standing adjacent the front of the leaning post.

20. The convertible seating system according to claim 19, wherein the top is pivotable into and between the lowered position and the raised position.

21. The convertible seating system according to claim 1, further comprising a sofa having a sofa seat and a sofa backrest that extends transversely relative to the sofa seat, wherein the sofa seat provides a sofa seating surface that is vertically aligned with the rearward seating surface of the reversible seat in the rearward seating position.

22. The convertible seating system according to claim 21, further comprising a table positioned between the sofa seat and the rearward seating surface of the reversible seat in the rearward seating position.

23. The convertible seating system according to claim 21, wherein the sofa is extendible towards the reversible seat into a lounge position in which the sofa and the rearward seating surface of the reversible seat provide a contiguous sunpad for a person laying on the sofa seat and the reversible seat.

24. The convertible seating system according to claim 21, wherein the sofa backrest is pivotable towards the sofa seat into a sofa storage position in which a backside of the sofa backrest provides a standing surface for an occupant of the marine vessel.

25. A convertible seating system for a marine vessel having a bow and a stern, the convertible seating system comprising a sofa having a sofa backrest and a sofa seat that extends transversely relative to the sofa backrest, wherein the sofa seat provides a sofa seating surface for a seated occupant facing the bow and wherein the sofa backrest provides a backrest surface for the seated occupant facing the bow, and further wherein the sofa seat comprises a sofa base and a sofa bed that is extendible out from under the sofa base into a lounge position in which the sofa seat and the sofa bed together provide a contiguous sunpad for an occupant of the marine vessel laying in a prone position, wherein the sofa comprises a sofa frame that supports the sofa seat and the sofa backrest, and wherein the sofa frame is pivotable relative to a hull of the marine vessel, which defines a storage area below the sofa seat.

26. The convertible seating system according to claim 25, further comprising sofa bed cushions stored in the storage area, the sofa bed cushions being configured for placement on the sofa bed in the lounge position.

* * * * *